US008128430B2

(12) United States Patent
Diessel

(10) Patent No.: US 8,128,430 B2
(45) Date of Patent: Mar. 6, 2012

(54) JUMPER AND STRUCTURAL UNIT COMPRISING AT LEAST TWO ELECTRICAL MODULAR TERMINALS AND ONE JUMPER

(75) Inventor: Thorsten Diessel, Hiddenhausen (DE

(73) Assignee: Phoenix Contact GmbH & Co. KG, Blomberg (DE)

( * ) Notice: Subject to any disclaimer, the term of this patent is extended or adjusted under 35 U.S.C. 154(b) by 2 days.

(21) Appl. No.: 12/922,625

(22) PCT Filed: Mar. 12, 2009

(86) PCT No.: PCT/EP2009/001791

§ 371 (c)(1),
(2), (4) Date: Sep. 14, 2010

(87) PCT Pub. No.: WO2009/112263

PCT Pub. Date: Sep. 17, 2009

(65) Prior Publication Data

US 2011/0014808 A1 Jan. 20, 2011

(30) Foreign Application Priority Data

Mar. 14, 2008 (DE) ..... 10 2008 014 179

(51) Int. Cl.
*H01R 31/08* (2006.01)

(52) U.S. Cl. ..... 439/507

(52) U.S. Cl. .....

(58) Field of Classification Search ..... 439/507, 439/512, 716, 709, 721, 723, 835, 792, 793; 337/198, 159, 186

See application file for complete search history.

(56) References Cited

U.S. PATENT DOCUMENTS

| | | | | | |
|---|---|---|---|---|---|
| 5,062,024 | A * | 10/1991 | Hennemann | 361/823 |
| 5,071,356 | A * | 12/1991 | Strate et al. | 439/49 |
| 5,816,852 | A * | 10/1998 | Conrad | 439/512 |
| 5,836,791 | A * | 11/1998 | Waas et al. | 439/709 |
| 5,853,304 | A * | 12/1998 | Landreau et al. | 439/721 |
| 6,157,287 | A * | 12/2000 | Douglass et al. | 337/198 |
| 6,506,071 | B2 * | 1/2003 | Lange | 439/358 |
| 7,168,977 | B2 * | 1/2007 | Reibke et al. | 439/507 |
| 7,192,316 | B1 * | 3/2007 | Pollmann | 439/716 |

FOREIGN PATENT DOCUMENTS

| | | | |
|---|---|---|---|
| DE | 1 132 618 | B | 7/1962 |
| DE | 44 11 306 | C1 | 5/1995 |
| DE | 197 42 785 | C1 | 8/1998 |
| DE | 299 09 766 | U1 | 10/2000 |
| DE | 299 21 080 | U1 | 4/2001 |
| DE | 102 55 674 | A1 | 6/2004 |
| DE | 10 2006 008 971 | A1 | 9/2007 |
| EP | 0 735 629 | A1 | 10/1996 |

OTHER PUBLICATIONS

International Search Report for International Application No. PCT/EP2009/001791 Dated Aug. 21, 2009.

* cited by examiner

*Primary Examiner* — Alexander Gilman
(74) *Attorney, Agent, or Firm* — Roberts Mlotkowski Safran & Cole, P.C.; David S. Safran

(57) ABSTRACT

A jumper that has a housing and is used for bridging two modular electric terminals which are arranged next to one another and are each equipped with a busbar. At least one opening is formed in the busbars. In order to be able to easily actuate the jumper according to the invention and flexibly and easily insert the same into multiple modular terminals, two mutually insulated contact elements are arranged in the housing so as to engage into an opening in a respective busbar, and a jumper rail is movably retained in the housing. The jumper rail, which has two contact zones and a connection zone that connects the contact zones, can be moved from a first final position in which the contact zones do not contact the contact elements into a second final position in which the contact elements are interconnected in an electrically conducting manner via the jumper rail.

24 Claims, 9 Drawing Sheets

JUMPER AND STRUCTURAL UNIT COMPRISING AT LEAST TWO ELECTRICAL MODULAR TERMINALS AND ONE JUMPER

BACKGROUND OF THE INVENTION

1. Field of the Invention

The invention relates to a jumper with a housing for bridging at least two electrical modular terminals which are located next to one another, the modular terminals each having at least one busbar and at least one opening being formed in each of the busbars. In addition, the invention relates to a structural unit comprising at least two electrical modular terminals located next to one another and a jumper which has a housing, the modular terminals each having a terminal housing made of insulating material, with at least two terminal elements located in it and at least one busbar, and in each of the terminal housings at least one functional slot being made for at least partially accommodating the jumper and at least one opening being made in the busbars.

2. Description of Related Art

Electrical modular terminals have been known for decades and are used in the millions in the wiring of electrical systems and devices. The terminals are generally locked onto support rails which for their part are often located in a plurality in the switching cabinet. The terminal elements in modular terminals are mainly screw-type terminals or tension spring terminals. In addition however insulation piercing connecting devices or leg spring terminals can also be used.

The basic type of modular terminal is the connecting terminal which has at least two terminal elements which are electrically connected to one another via an electrically conductive connecting rail, the busbar. In addition to this basic type, which is often called a feed-through terminal, there is a host of different modular terminal types which are matched especially to the respective application. Examples are protective-conductor terminals, isolating terminals and test terminals.

In particular, for modular terminals which are used in current transformer measurement circuits in power generation and distribution, various switching, isolating and testing tasks must often be performed. They include the bridging of adjacent modular terminals using plug-in jumpers which are plugged into the terminal housings and with which two or more adjacent modular terminals can be short circuited. For example, a current transformer short circuit can thus be implemented in a current transformer measurement circuit.

One such plug-in jumper is disclosed, for example, in German Patent DE 44 11 306 C1. The plug-in jumper consists of two jumper rail sections which are located parallel to one another and which each have a rail strip and a plurality of contact legs which are connected to the rail strip. In the known plug-in jumper, the spring forces of the contact legs, upon plugging into the openings in the busbars of the modular terminals and during contact-making, are aligned parallel to the lengthwise direction of the rail strip so that locking between the plug-in jumper and the busbar can be easily achieved.

Moreover, jumpers are known from practice which are arranged to be able to move in the terminal housings of adjacent modular terminals (CLIPLINE 2007 catalog, page 104, of Phoenix Contact GmbH & Co. KG). The jumpers have at least two contact regions which are connected to one another in an electrically conductive manner and which, in the contact position, can be connected to the busbar by a screw which has been screwed into the busbar of the modular terminal. The disadvantage here is that the jumper can be used only in special modular terminals in which, on the one hand, a threaded hole is made in the busbar for the screw, and on the other hand, the busbar is made such that, in general, a screw which is accessible from the outside can be screwed into the busbar, i.e., the busbar or a section of the busbar must run near the top of the terminal housing.

SUMMARY OF THE INVENTION

The object of this invention is to provide a jumper of the initially described type which can be actuated as easily as possible and which can be used flexibly and easily for several modular terminals. Moreover, the object of the invention is to also provide a structural unit comprising at least two electrical modular terminals which are located next to one another and a jumper which can be actuated more easily and flexibly and can be adapted to different conditions of use.

These objects are achieved in the initially described jumper according to the first teaching of the invention in that there are at least two contacts in the housing which are insulated from one another for engaging an opening in a respective one of the busbars and that a jumper rail is movably held in the housing, the jumper rail having at least two contact regions and a connecting region which connects the contact regions and can be moved out of a first end position, in which the contact regions do not make contact with the contacts, into a second end position in which the contacts are connected to one another in an electrically conductive manner via the jumper rail.

The operating principle of the jumper in accordance with the invention differs from the above described known plug-in jumpers by the jumper in accordance with the invention, first, being plugged into the electrical modular terminals which are located next to one another, the contacts which are insulated from one another engaging an opening in a respective busbar, and thus, making contact with the busbars. If the jumper rail is in the first end position the contacts of the jumper are not connected to one another, i.e., the electrical modular terminals located adjacent to one another are not yet electrically bridged via the jumper. The bridging of the modular terminals located adjacent to one another by means of the jumper which has been plugged into the modular terminals takes place at this point by the jumper rail being pushed out of the first end position into the second end position, the contact regions which are electrically connected to one another via the connecting region in the second end position making contact in an electrically conductive manner with the contacts so that the contacts, and thus, also the busbars of adjacent modular terminals with which the contacts have made contact are connected to one another in an electrically conductive manner via the jumper rail.

According to a first advantageous configuration of the invention, the ends of the contacts facing the contact regions of the jumper rail and the contact regions of the jumper rail are located parallel to one another. A respective screw is screwed in the ends of the contacts facing the contact regions of the jumper rail. If the jumper rail is pushed out of the first end position into the second end position, the contact regions of the jumper rail are pushed over the ends of the contacts, and then a respective contact region of the jumper rail can be connected in an electrically conductive manner to the facing end of the contact by means of a screw. By tightening the screws, on the one hand, an electrically conductive connection between the contact regions of the jumper rail and the contact is established, and on the other hand, in this way, the jumper rail is fixed in the second end position. For this purpose, the contact regions of the jumper rail preferably have a recess which is open on one side and which extends at least partially around the shaft of a screw in the second end position of the jumper rail.

Because the electrical connection between the contact regions of the jumper rail and the contacts is accomplished by tightening the screws, it is ensured that both the switching and closing of the bridging and also the disconnecting or opening of the bridging cannot take place unintentionally. By using screws, the high level of safety which is required in current and voltage transformer circuits is thus ensured.

According to one version of the jumper in accordance with the invention, the ends of the contacts facing the contact regions of the jumper rail and the contact regions of the jumper rail in the second end position of the jumper rail can each be locked relative to one another. For this purpose, the ends of the contacts are preferably made as pin-shaped locking elements and the contact region of the jumper rail is made as catch recesses. When the jumper rail is moved out of the first end position into the second end position, locking of the pin-shaped locking elements in the catch recesses of the contact regions thus takes place. In this version, the use of screws is eliminated so that the jumper which has been plugged into the modular terminals can be actuated without tools.

According to another preferred configuration of the jumper in accordance with the invention, both according to the first and also according to the second version, the contact regions and the connecting region of the jumper rail are made in one piece, the contact regions being bent essentially perpendicularly away from the connecting region. The jumper rail can be produced very easily, for example, as a punched and bent part, by the one-piece execution of the contact regions with the connecting region. Because the contact regions are bent essentially perpendicularly away from the connecting region, actuation of the jumper rail is especially easily possible. For this purpose, it is also provided that the connecting region of the jumper rail is located at least partially in an insulating housing or is jacketed by an insulating housing. The insulating housing thus acts as an insulating head on which the jumper rail can be touched when displaced out of the first end position into the second end position. Thus, the insulating housing ensures the required safety against finger contact.

According to another advantageous configuration, in the housing of the jumper, at least one brace is formed which runs in the movement direction of the jumper rail, and in the connecting region or in the insulating housing of the jumper rail, at least one corresponding groove is formed. Guidance of the jumper rail thus takes place by the brace and the corresponding groove upon displacement out of one end position into the other end position by the jumper rail with the groove sliding along the brace. In order to further facilitate the displacement of the jumper out of one end position into the other end position and to prevent tilting of the jumper during displacement, it is moreover provided that two guide grooves are formed in the side walls of the housing and on the jumper rail, especially on the insulating housing, two corresponding guide ribs or guide braces are formed laterally. When the jumper rail is moved out of one end position into the other end position, then the guide ribs or the guide braces slide in the guide grooves, by which both tilting as well as unwanted release of the jumper rail from the housing of the jumper are prevented.

It was stated at the beginning that the jumper in accordance with the invention can be plugged into two or more modular terminals which are located next to one another and locked in them. The jumper can be locked in the modular terminal solely by the contacts being made such that, upon engaging the opening in a respective one of the busbars, they not only make electrically conductive contact, but at the same time also lock in the opening of the busbar. This can be achieved especially by the contacts being made as spring contacts, each spring leg having two contact legs which are arranged parallel to one another and at least one of which is elastic. A catch projection can be then formed on one or both contact legs by which locking of the contacts in the opening is achieved.

However, according to the preferred configuration of the invention, locking of the jumper in the modular terminal or in the modular terminals takes place not only via the contacts, but in addition or alternatively via at least two elastic catch elements which are located on the housing and which can be plugged into a second opening in the respective one of the busbars. So that this jumper can be plugged into electrical modular terminals which are located next to one another, it is thus necessary that at least two openings are formed in the busbars of the modular terminals. When the jumper is plugged into the modular terminals, in doing so, a respective contact engages a first opening and a catch element engages a second opening of a respective jumper, the locking of the jumper being ensured primarily by the elastic catch elements, while the contacts are used for electrical contact-making of the busbars.

The object of the invention is achieved in the initially described jumper according to a second alternative teaching of the invention in that the housing of the jumper can be locked on the modular terminals and that a plug-in jumper with at least two contacts which are connected to one another in an electrically conductive manner via a connecting region is arranged to be able to move axially on the housing, the plug-in jumper being able to move out of a first position in which the contacts do not make contact with the openings in the busbars into a second position in which the contacts engage the openings in the busbars.

In a second alternative of the invention, the jumper is also locked, in a first step, on the modular terminals and plugged into the modular terminals before bridging of the adjacent modular terminals in a second step, such that the plug-in jumper which is located to be able to move axially on the housing out of a first position in which the contacts which are electrically connected to one another do not make contact with the openings in the busbars, into a second position in which a respective contact engages an opening of a busbar. In this version of the jumper, the plug-in jumper can be made essentially according to a "normal" plug-in jumper, the plug-in jumper however not being plugged directly into openings in the busbars of adjacent modular terminals, but the jumper first being attached to the modular terminals and afterwards the plug-in jumper being pushed into its second position (contact-making position).

Fundamentally, there are various possibilities for how the housing of the jumper can be locked in the modular terminals. For example, there can be catch pivots laterally on the housing, and in the terminal housing of the modular terminals there can be corresponding catch recesses. According to a preferred configuration of the jumper according to the second teaching of the invention it is however provided that the jumper is likewise locked in the modular terminal in that on the housing of the jumper there are at least two elastic catch elements for locking in the second opening in one of the busbars at a time. In this way, the jumper can also be easily plugged into the openings in the busbars of the modular terminals with elastic catch elements according to a second teaching of the invention. In this connection, the jumper can therefore also be easily attached simply by vertically plugging into the modular terminal housing. Then, bridging takes place by the plug-in jumper being moved out of its first position into the second position.

Preferably, at least the connecting region of the plug-in jumper is located in an insulating housing or is jacketed by the insulating housing. The insulating housing thus, in turn, forms an insulating head so that fundamentally it is possible to move the plug-in jumper by hand out of the first position into the second position.

The an advantageous configuration is implemented in that two guide ribs are made on the housing and two corresponding guide grooves are made in the insulating housing. In the displacement of the plug-in jumper out of the first position into the second position the guide grooves slide along the guide ribs of the housing so that the plug-in jumper travels along a defined displacement path out of the first position into the second position. Of course, it is also possible to interchange the arrangement of the guide ribs and guide grooves so that two guide ribs are made on the insulating housing and two corresponding guide grooves are made in the housing.

It was stated above that it is fundamentally possible to move the plug-in jumper by hand out of the first position into the second position, i.e., to press it into the interior of the modular terminal housing. According to a preferred embodiment of the jumper in accordance with the invention, however, it is provided that an actuating element is pivotally mounted on the housing whose one end is connected to the insulating housing of the plug-in jumper. By pivoting of the actuating element the plug-in jumper can then be pushed out of the first position into the second position. Actuation of the plug-in jumper by means of the actuating element can be further facilitated by the second end of the actuating element having a receiver for inserting a tool, for example, the tip of a screwdriver. In this way, the actuation of the plug-in jumper can take place very easily even with small dimensions of the jumper by the tip of a tool being inserted into the receiver of the actuating element and then the tool being pivoted, by which the plug-in jumper is moved axially out of its first position into its second position.

As in the jumper according to the first teaching of the invention, in the jumper according to the second teaching of the invention, the contacts are also preferably made as spring contacts, each spring contact having two contact legs which are located parallel to one another, of which at least one is elastic. Alternatively, it is also possible to make the contacts as pin contacts, then the jumper locks in the modular terminals preferably via elastic catch elements which are located on the housing.

In the initially described structural unit comprising at least two electrical modular terminals which are located next to one another and a jumper, the object of the invention according to a first teaching of the invention is also achieved in that in the housing of the jumper there are at least two contacts which are insulated from one another for engaging an opening in a respective busbar of the modular terminals and that a jumper rail is movably held in the housing of the jumper, the jumper rail having at least two contact regions and a connecting region which connects the contact regions and is able to be moved out of a first end position into a second end position. As has already been described in conjunction with the jumper according to the first teaching of the invention, in the structural unit in accordance with the invention, the contacts are also connected to one another in an electrically conductive manner in the second position via the jumper rail, while in the first end position of the jumper rail the contact regions do not make contact with the contacts.

According to an advantageous configuration of the structural unit in accordance with the invention, the housing of the jumper is made roughly L-shaped, the region of the housing in which the jumper rail is movably held having an open bottom so that a tool or a contact pin can be pushed through the open bottom of the jumper and can be inserted into the modular terminal housing when the jumper rail is located in the second end position. If the modular terminal housing has several functional slots and the busbar has several openings corresponding to the functional slots, it is fundamentally possible to plug the contacts of the jumper into any functional slot or any opening in the busbar. The above described preferred configuration in which the region of the housing in which the jumper rail is movably held has an open bottom ensures that the functional slot into which the jumper has not been plugged is not covered by the housing of the jumper to such an extent that this functional slot can no longer be used for plugging in the contact pin of a test plug or another plug-in jumper.

According to another advantageous configuration of the structural unit in accordance with the invention, the housing of the jumper is dimensioned such that the jumper can be plugged into the housing of adjacent modular terminals in such a way that an electrical conductor connected to a terminal element of the modular terminal cannot be removed from the terminal element when the jumper rail is in the first end position. The jumper can thus be dimensioned and arranged such that an actuating slot which is located underneath the housing of the jumper with the jumper plugged in is accessible for opening of a terminal element only when the jumper rail is in the second end position, i.e., when bridging with the adjacent modular terminal has been completed.

As in the plug-in jumper in accordance with the invention, in the structural unit in accordance with the invention, the object of the invention according to a second teaching of the invention is achieved in that the housing of the jumper can be locked in the modular terminals and that, on the housing of the jumper, a plug-in jumper with at least two contacts which are connected to one another in an electrically conductive manner via the connecting region is arranged to be able to move axially, the plug-in jumper being movable out of a first position in which the contacts do not make contact with the openings in the busbars into a second position in which one contact at a time engages the opening of the busbar.

According to one advantageous configuration of this structural unit, in the modular terminal housings, at least two functional slots are provided and in the busbars at least two corresponding openings are provided. Then, on the housing of the jumper, there are preferably at least two elastic catch elements for locking in the second opening in a respective one of the busbars, so that the jumper can be easily plugged into the functional slots of the modular terminals and can be locked in the openings of the busbar by means of the elastic catch elements. Preferably, it is provided here that the catch elements each have two elastic catch hooks opposite one another. In this way, it is ensured that simply by inserting the catch elements into the openings in the busbars the jumper is fastened relatively securely on the modular terminals or in the terminal housings.

It was stated above that the structural unit consists of at least two electrical modular terminals which are located next to one another, and one jumper. If the structural unit has two modular terminals located next to one another, in the housing of the jumper there are two contacts which are insulated from one another for engaging the opening in one of the busbars of the two jumpers at a time. This jumper is thus a 2-pin jumper. Moreover the jumper can however also be designed for bridging more than two modular terminals located next to one another so that then there is a correspondingly larger number of contacts in the housing, for example four or six contacts, so that it is a 4-pin or 6-pin jumper. In this case the structural unit then consists of a corresponding number of electrical modular terminals located next to one another and a correspondingly made jumper which has a number of contacts which corresponds to the number of modular terminals.

In particular, there is now a host of possibilities for embodying and developing the jumper in accordance with the invention and the structural unit in accordance with the invention. In this regard reference is made to the following detailed description of preferred embodiments in conjunction with the accompanying drawings.

DETAILED DESCRIPTION OF THE INVENTION

Figure 1:
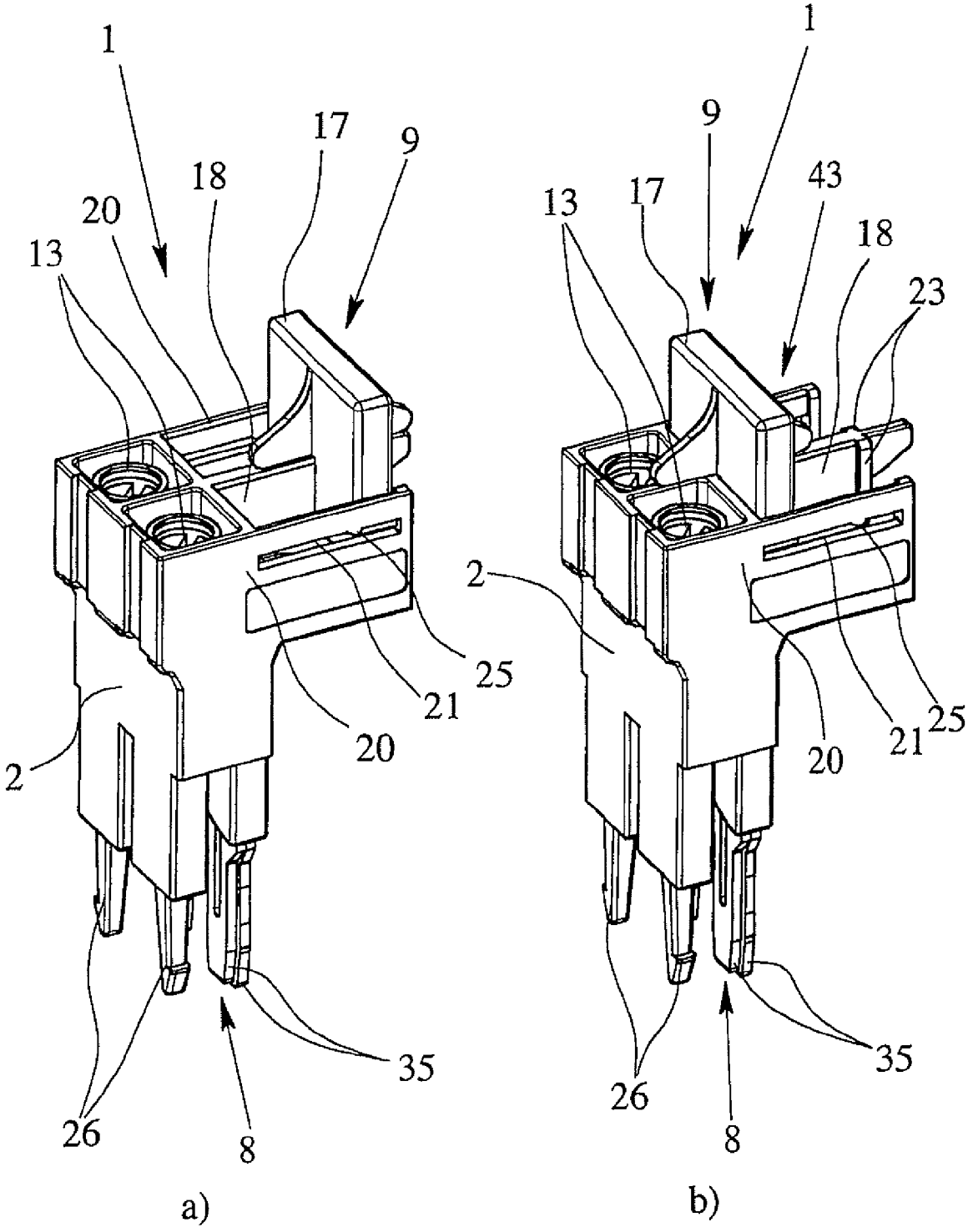
FIGS. 1(*a*) & 1(*b*) show two perspective views of a first embodiment of the jumper in accordance with the invention, with a jumper rail in the first end position and in the second end position.

FIGS. 1(*a*), 1(*b*) and 2, 5 and 6 as well as 7(*a*)-(*c*) show three different embodiments of the jumper 1 in accordance with the invention. The jumper 1 shown in the figures is used for bridging of two electrical modular terminals 3, 3' which are located next to one another (see, FIG. 8), the modular terminals 3, 3' each have a busbar 4, 4', and three openings 5, 6, 7 formed in each of the two sides of the middle region of the busbars 4, 4'.

In the housing 2 of the jumper 1, there are two contacts 8 for engaging a respective one of the openings 5, 7 in one of the two busbars 4, 4' of the modular terminals 3, 3'. Moreover, a jumper rail 9 is movably held in the housing 2, the jumper rail 9 having two contact regions 10 and a connecting region 11 which connects the contact regions 10, as is especially apparent from FIG. 4.

As the representations of FIGS. 1(*a*) & 1(*b*) show, the jumper rail 9 can be moved out of a first end position (FIG. 1(*a*)) into a second end position (FIG. 1(*b*)). In the first end position of the jumper rail 9, the contact regions 10 are spaced apart from the contacts 8 while the contact regions 10 in the second end position of the jumper rail 9 make electrically conductive contact with a respective contact 8 so that the two contacts 8 are connected to one another in an electrically conductive manner via the jumper rail 9.

Figure 2:
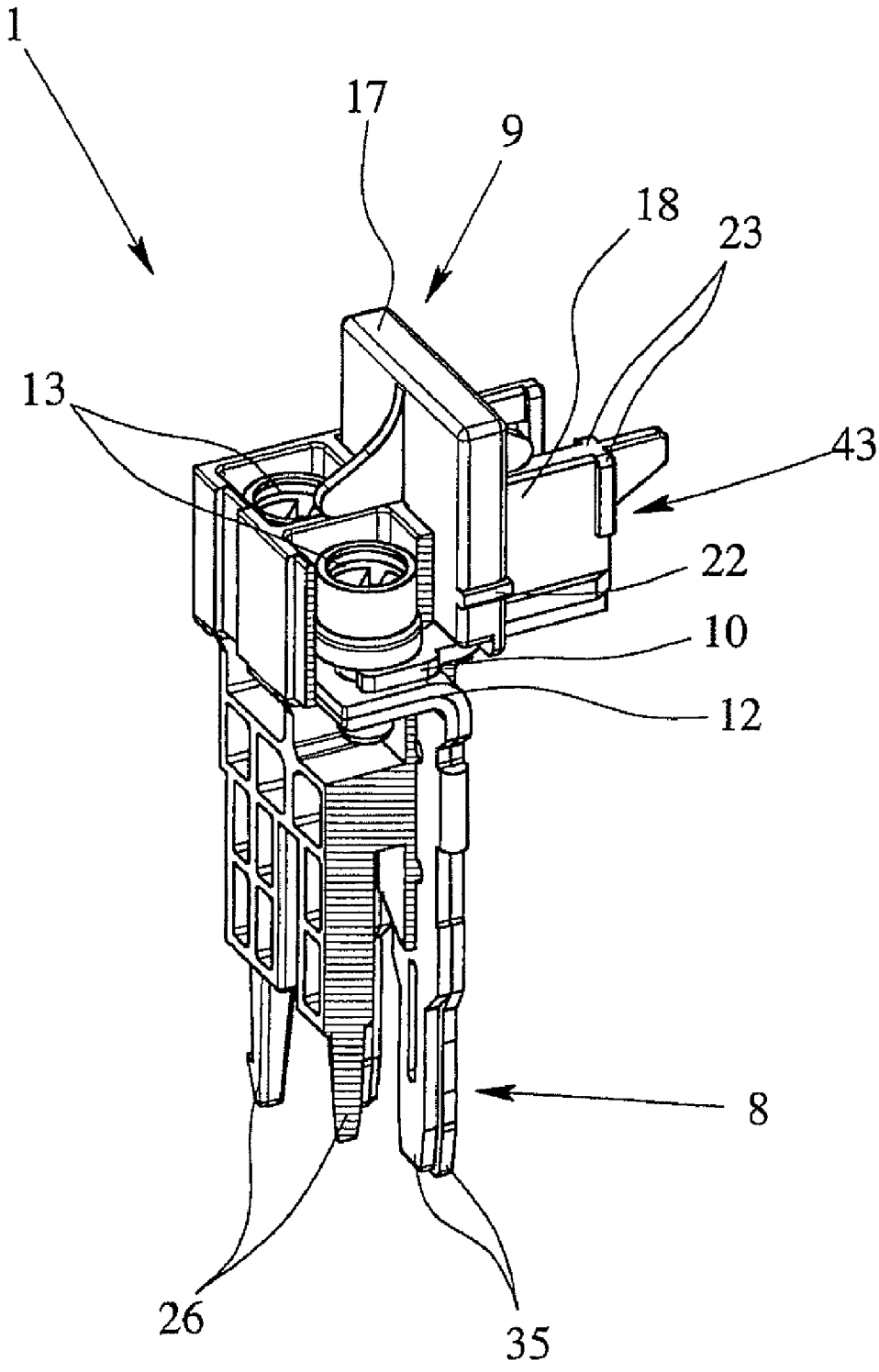
FIG. 2 is a partial sectional view of the jumper as shown in FIG. 1.
Figure 3:
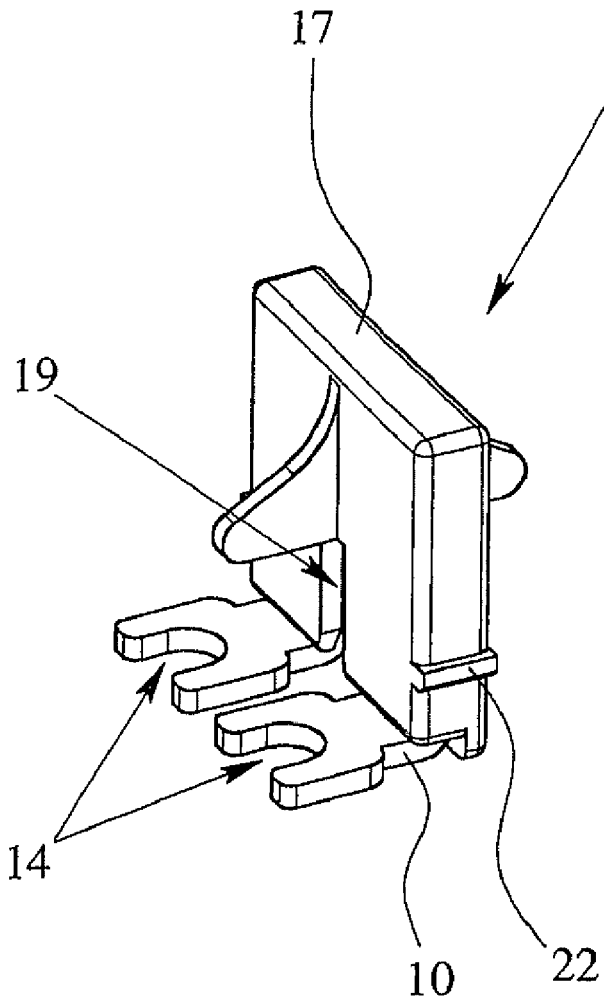
FIG. 3 is an enlarged perspective view of a jumper rail.
Figure 4:
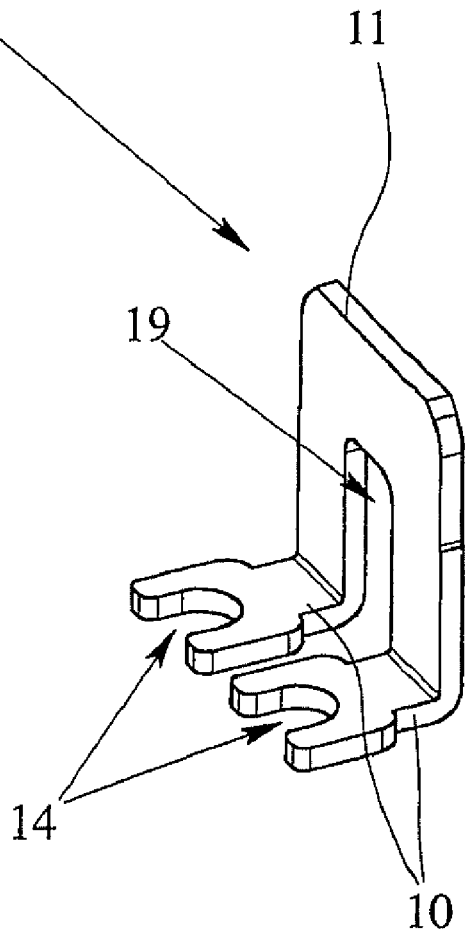
FIG. 4 shows the jumper rail of FIG. 3 without the insulating housing.

FIG. 2 shows that, in the first embodiment of the jumper 1, the ends 12 of the contacts 8 facing the contact regions 10 of the jumper rail 9 and the contact regions 10 are arranged parallel to one another, the contact regions 10 in the second end position of the jumper rail 9 being slipped onto the ends 12 of the contacts 8. The electrical connection between the contacts 8 and the contact regions 10 of the jumper rail 9 is achieved in that a respective screw 13 is screwed in the ends 12 of the two contacts 8 so that, by tightening the two screws 13, the two contact regions 10 of the jumper rail 9 are each connected in an electrically conductive manner to a respective end 12 of a contact 8. Moreover, by tightening the screws 13, the jumper rail 9 is also fixed in the second end position. In particular, FIGS. 3 & 4 show that the contact regions 10 of the jumper rail 9 each have a recess 14 which is open on one side and which, in the second end position of the jumper rail 9, extend partially around the shaft of one of the two screws 13.

Figure 5:
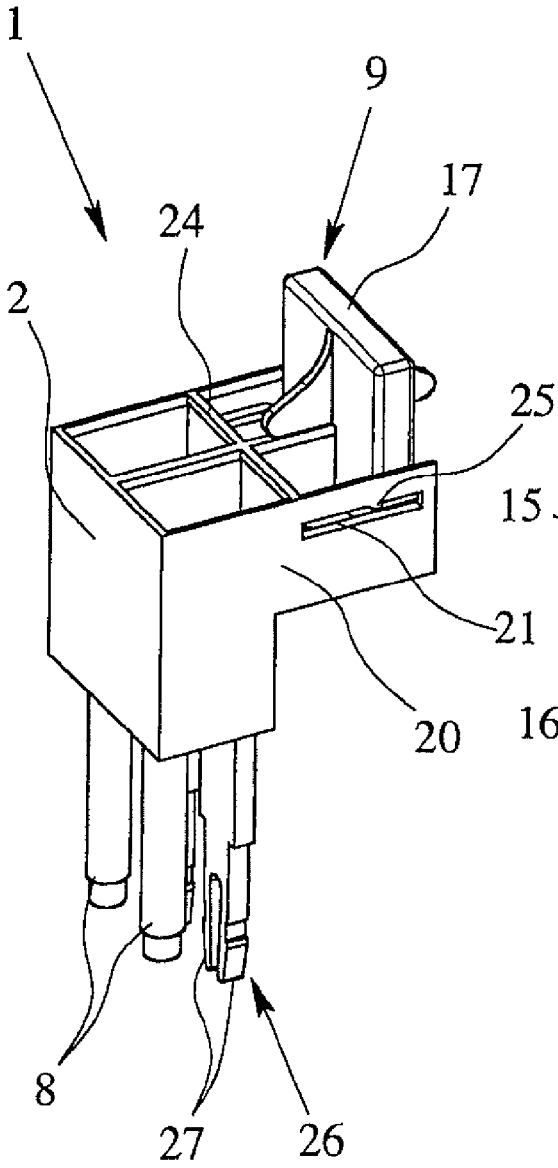
FIG. 5 is a perspective of a second embodiment of a jumper.
Figure 6:
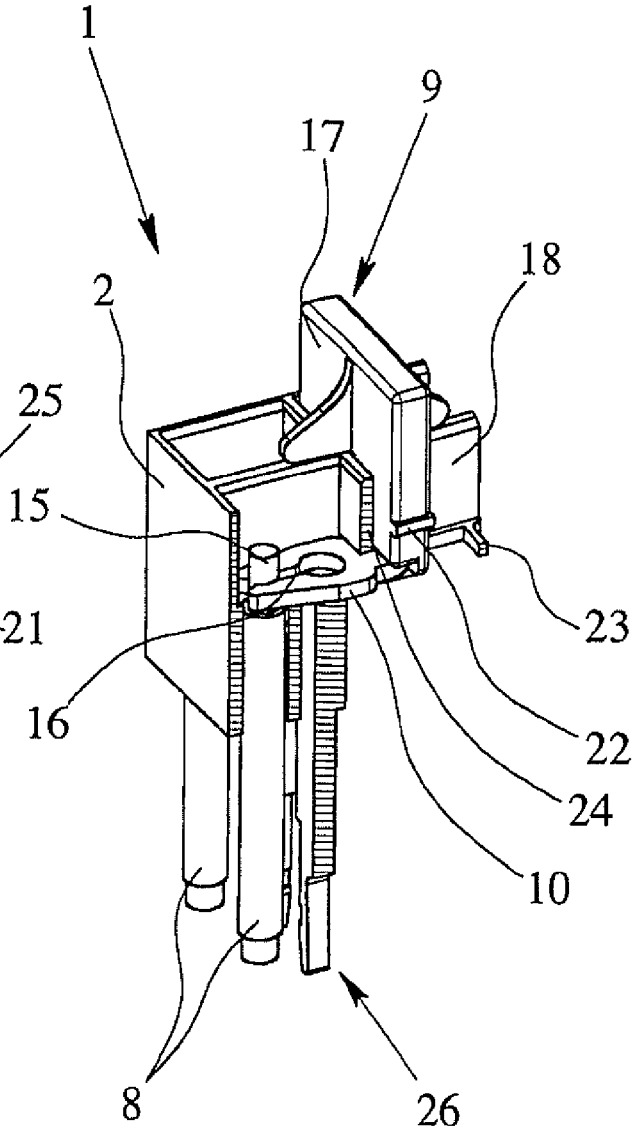
FIG. 6 is a partial sectional view of the jumper of FIG. 5, FIGS. 7(*a*)-7(*c*) are three perspectives of a third embodiment of a jumper in accordance with the invention.

In the second exemplary embodiment of the jumper 1 in accordance with the invention which is shown in FIGS. 5 & 6, the ends 12 of the contacts 8 have a pin-shaped locking element 15 and the contact regions 10 of the jumper rail 9 have a corresponding catch recess 16. In this way, the contacts 8 and the contact regions 10 of the jumper rail can be locked relative to one another in the second end position of the jumper rail as is shown in FIG. 6. The use of screws for implementing the electrically conductive connection between the contacts 8 and the contact regions 10 or the jumper rail 9 is thus unnecessary in this embodiment. When the jumper rail 9 is moved into the second end position, the pin-shaped locking elements 15 slide automatically into the catch recesses 16 of the contact regions 10.

The jumper rail 9 is preferably a simple punched and bent part in which the contact regions 10 and the connecting region 11 are connected integrally to one another so that the jumper rail 9 is made in one piece. Moreover, the contact regions 10 are bent essentially perpendicularly away from the connecting region 11 so that the contact regions 10 can be easily connected to the screws 13 and the pin-shaped locking elements 15 of the contacts 8 upon displacement from the first end position into the second end position. The connecting region 11 of the jumper rail 9 is located in an insulating housing 17 so that the jumper rail 9 can be moved by hand out of one end position into the other end position.

In order to ensure good guidance of the jumper rail 9 within the housing 2, both for the jumper 1 as shown in FIGS. 1(*a*), 1(*b*) and 2 as well as for the jumper 1 as shown in FIGS. 5 and 6, a brace 18 is formed in the housing 2 that runs in the displacement direction of the jumper rail 9 and a corresponding groove 19 is formed in the insulating housing 17 of the jumper rail 9. The jumper rail 9 thus sits with its groove 19 on the brace 18 of the housing 2. In addition, reliable guidance of the jumper rail 9 in displacement out of one end position into the other end position is ensured in that in the side walls 20 of the housing 2 two guide grooves 21 are formed and on the insulating housing 17 of the jumper rail 9 two corresponding guide ribs 22 are laterally formed which are guided in the guide grooves 21.

Moreover on the housing 2 both a stop 23 for the jumper rail 9 in the first end position and also a stop 24 for the jumper rail 9 in the second end position are made. The stop 23 is implemented by two ribs which are formed laterally on the brace 18, while the stop 24 is a partition which runs transversely to the direction of movement of the jumper rail. FIGS. 1 and 5 moreover show that one catch projection 25 at a time projects into the guide grooves 21 in the side walls 20; the catch projection together with the guide ribs 22 on the insulating housing 17 of the jumper 9 provides for the jumper rail 9 to lock in the first end position in the housing 2. The locking between the catch projection 25 in the guide groove 21 and the guide rib 22 is however only so strong that unintentional slipping of the jumper rail 9 out of the first end position is prevented. For intentional manual displacement of the jumper rail 9 out of the first end position into the second end position conversely the locking can be simply overcome.

For reliable mechanical attachment of the jumper 1 when plugged into the modular terminals 3, 3', two elastic catch elements 26 are formed on the housing 2 of the jumper 1 which lock in a second opening 6 in the two busbars 4, 4'. For the jumper 1 as shown in FIGS. 1 and 2, a respective catch projection is formed on the end of the two catch elements 26, while for the jumper 1 as shown in FIG. 5, the catch elements 26 each have two elastic catch hooks 27 opposite one another.

Figure 9:
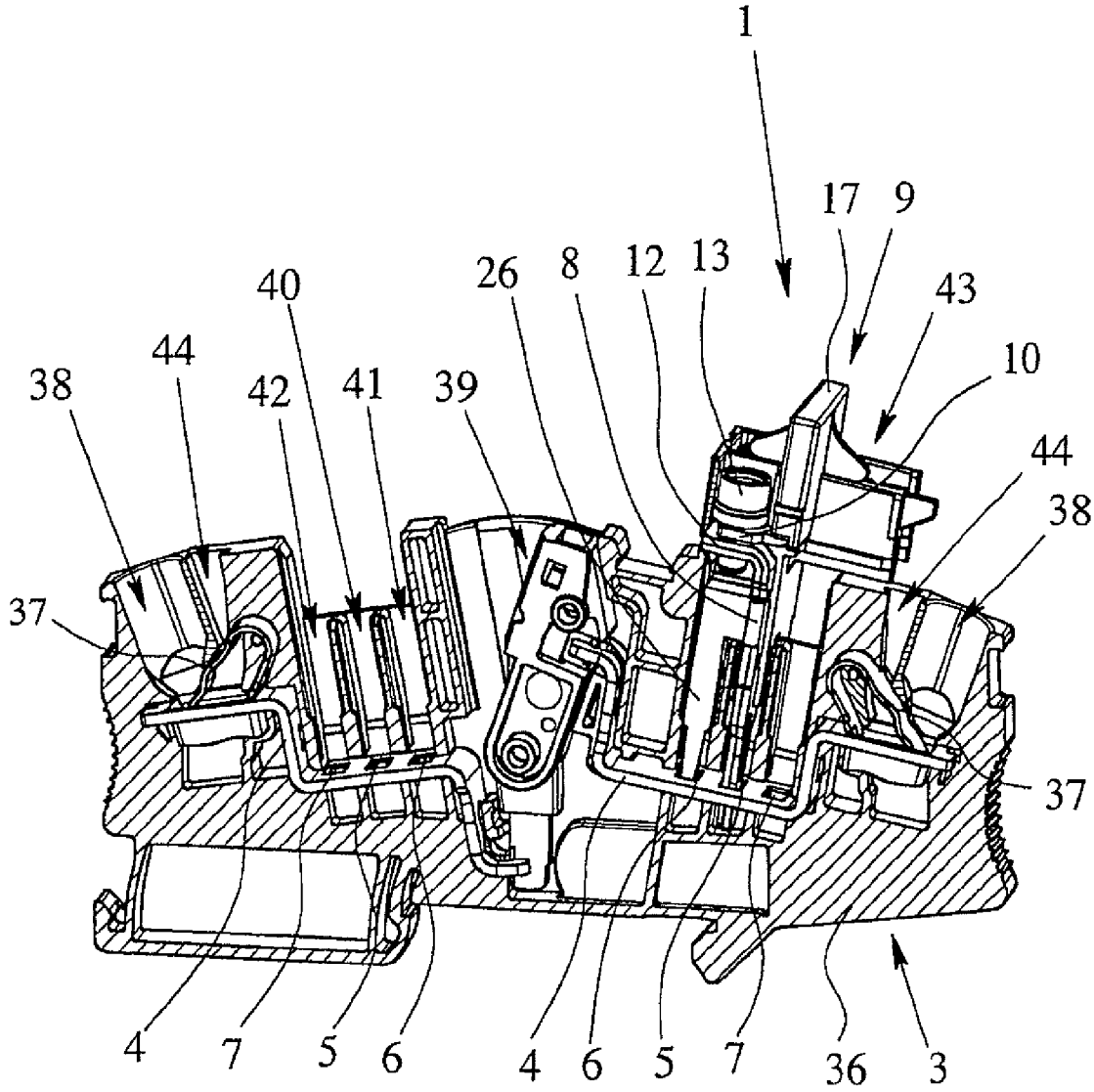
FIG. 9 shows a longitudinal sectional view of the structural unit as shown in FIG. 8, with a switching element in the second end position.
Figure 10:
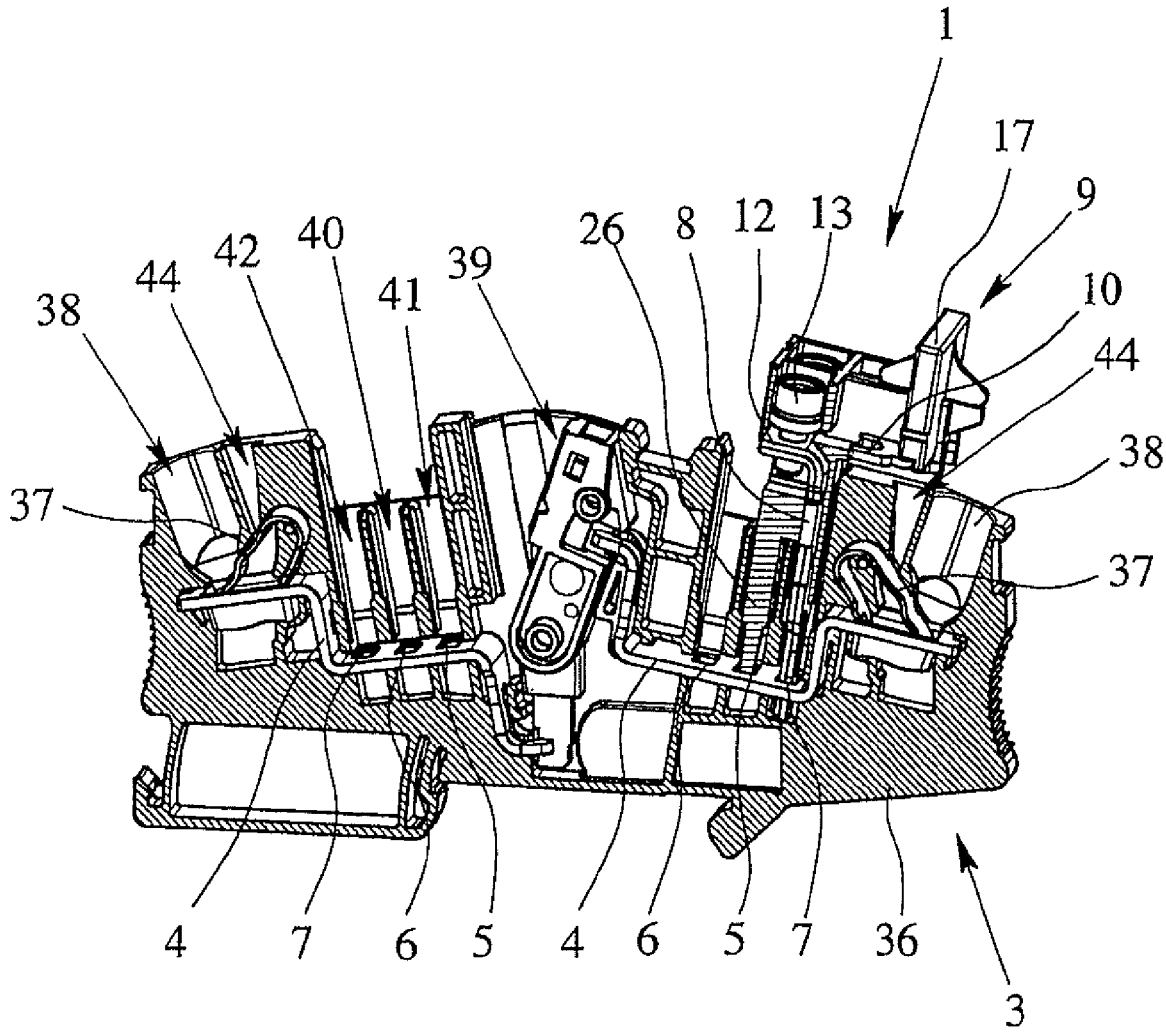
FIG. 10 shows a longitudinal sectional view of the structural unit as shown in FIG. 8, with a switching element in the first end position.

As is apparent from FIG. 9, when the jumper 1 is plugged into the modular terminals 3, 3', the two contacts 8 each lock in the middle opening 5 in the two busbars 4, 4', by which the two busbars 4, 4' make contact with the contacts 8. In addition, the two catch elements 26 each lock in the inner opening 6 in the two busbars 4, 4'. The catch elements 26 are used solely for mechanical locking of the jumper 1 or of the housing 2 in the modular terminals 3, 3'. In the exemplary embodiment as shown in FIG. 10, the jumper 1 is plugged into the modular terminals 3, 3' such that the two contacts 8 each lock in the outer opening 7 and the catch elements 26 each lock in the middle opening 5 in the two busbars 4, 4'.

Figure 7:
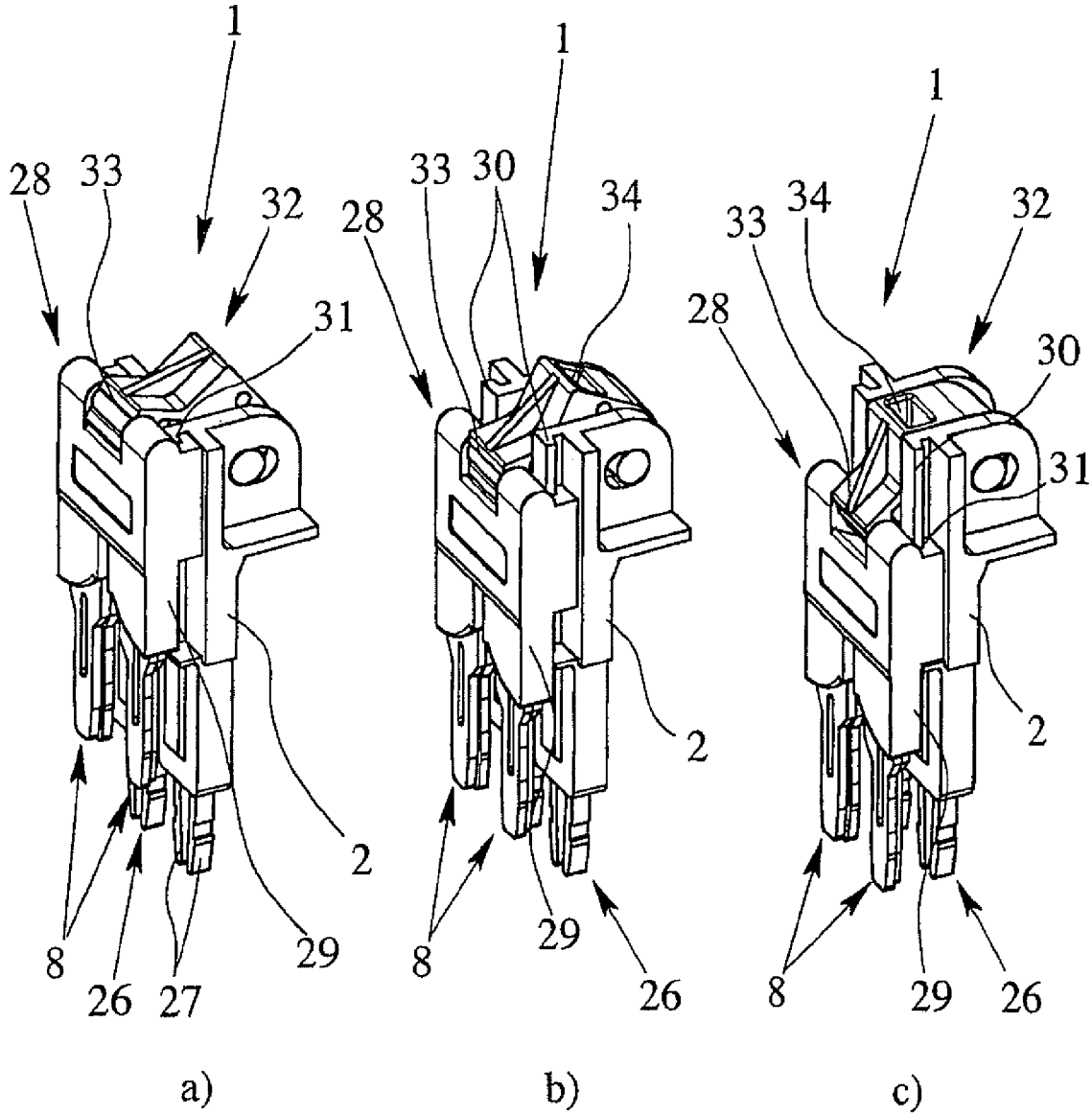

FIG. 7 shows a third exemplary embodiment of a jumper 1 in which a plug-in jumper 28 is located on the housing 2 so as to be able to move axially. The plug-in jumper 27 likewise has two contacts 8 which can each be plugged into one of the openings 5, 6, 7 in the two busbars 4, 4'. In contrast to the contacts 8 of the jumper 1 as shown in FIGS. 1(*a*), 1(*b*) and 2 as well as in FIGS. 5 and 6, the contacts 8 of the plug-in jumper 28 and of the jumper 1 as shown in FIGS. 7(*a*)-(*c*) are connected to one another in an electrically conductive manner via a connecting region. As is apparent from the three representations shown in FIGS. 7(*a*)-(*c*), the plug-in jumper 28 can be moved axially out of a first position (FIG. 7*a*) into the second position (FIG. 7*c*).

If the jumper 1 with the plug-in jumper 28 in the first position as shown in FIG. 7(*a*) is plugged into the two electrical modular terminals 3, 3', first the two catch elements 26 with their elastic catch hooks 27 opposite one another lock in the two openings in a respective one of the two busbars 4, 4'. In this first position of the plug-in jumper 28, the contacts 8 are not yet plugged in the first openings in the two busbars 4, 4' so that the busbars 4, 4' have not yet made contact with the contacts 8. If the plug-in jumper 28 as shown in FIG. 7(*c*) is pushed into the second position, the contacts 8 engage the second openings in the two busbars 4, 4' so that the two busbars 4, 4' of the electrical modular terminals 3, 3' which are located next to one another are short-circuited via the plug-in jumper 28.

According to the insulating housing 17 of the jumper rail 9, the plug-in jumper 28 also has an insulating housing 29 in its connecting region so that the plug-in jumper 28 is also made safe from contact with the hands. To ensure good axial guidance of the plug-in jumper 28, two guide ribs 30 are formed laterally on the housing 2 of the jumper 1 and corresponding thereto two guide grooves 31 are made in the insulating housing 29. The plug-in jumper 28 could thus be pressed down simply by hand out of the first position (FIG. 7*a*) into the second position (FIG. 7*c*).

However, in order to facilitate movement of the plug-in jumper 28, an actuating element 32 is pivotally supported on the housing 2 and an end 33 of which is connected to the insulating housing 29 so that, by pivoting the actuating element 32, the plug-in jumper 28 is pushed out of the first position into the second position. For simple actuation of the actuating element 32 a receiver 34 is made in its other end for inserting a tool, for example, the tip of a screwdriver. The plug-in jumper 28 can thus be easily moved out of the first position into the second position so that the tip of a screwdriver is inserted into the receiver 34 in the actuating element 32 and then the screwdriver is turned counterclockwise.

While in the two exemplary embodiments as shown in FIGS. 1(*a*), 1(*b*) and 7(*a*)-(*c*), the contacts 8 are made as spring contacts, in the exemplary embodiment as shown in FIGS. 5 & 6, the contacts 8 are made as pin contacts. The contacts 8 which are made as spring contacts have two contact legs 35 which are arranged parallel to one another, and of which at least one is made elastic.

Figure 8:
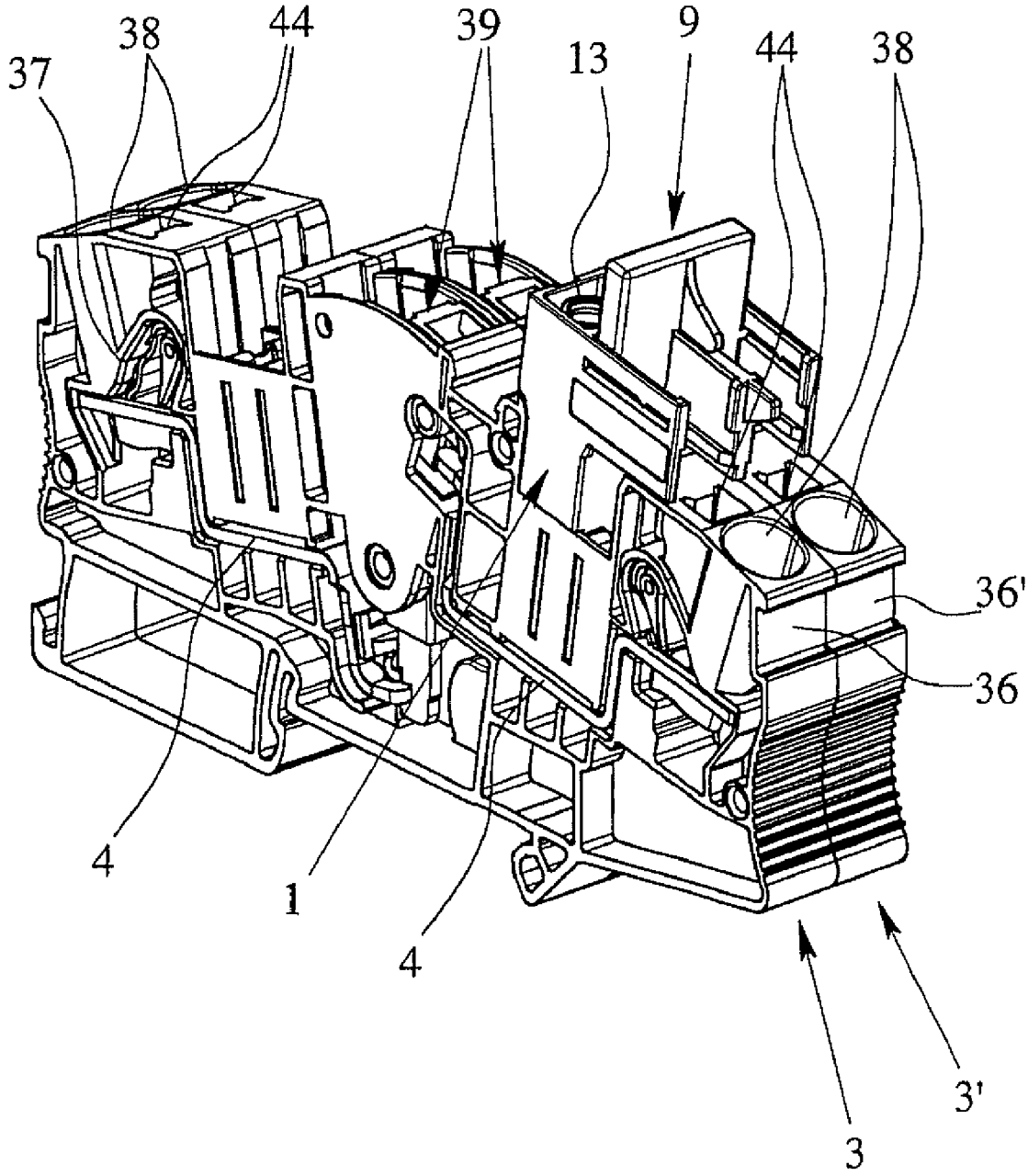
FIG. 8 is a perspective of a structural unit composed of two electrical modular terminals which are located next to one another and a jumper as shown in FIG. 1.

FIGS. 8 to 10 show a structural unit composed of two electrical modular terminals 3, 3' which are located next to one another and which can be locked jointly on a support rail (not shown), and a jumper 1 which has been plugged into the modular terminals 3, 3'. The modular terminals 3, 3' each have a terminal housing 36, 36' which is made of insulating material and in which there are two terminal elements 37 and a busbar 4, 4'. In this exemplary embodiment, the terminal elements 37 are leg spring terminals into which rigid conductors can be plugged directly through the corresponding conductor insertion openings 38 in the terminal housing 36, 36'.

Since the modular terminals 3, 3' shown in FIGS. 8 to 10 are feed-through terminals with a disconnect possibility, so-called isolating terminals, the busbars 4, 4' each are formed of two sections which can be connected to one another in an electrically conductive manner or can be separated from one another via a section disconnector which is pivotally located in the middle of the modular terminals 3, 3'. The structure of the modular terminals 3, 3' is essentially identical on both sides of the section disconnector 39, in particular in the terminal housing 36, 36' on both sides of the section disconnector 39 three functional slots 40, 41, 42 are made which, corresponding to the three openings 5, 6, 7, are located in the two parts of the busbar 4, 4'. The jumper 1 can be alternatively plugged into the terminal housings 36, 36' on one of the two sides of the section disconnector 39. Moreover, the jumper 1 with its contacts 8 can be plugged either into the opening 5 in the two busbars 4, 4' (FIG. 9) or into the opening (7) (FIG. 10). The catch elements 26 are then plugged either in the openings 6 (FIG. 9) or in the openings 5 (FIG. 10) of the busbars 4, 4'. Moreover, the jumper 1 can also be plugged into the modular terminals 3, 3' turned by 180° so that the region 43 of the housing 2 of the jumper 1 in which the jumper rail 9 is movably guided is located over the middle region of the terminal housing 36, 36'.

As is apparent for the FIGS. 1(*a*) & 1(*b*) embodiment, the housing 2 of the jumper 1 is made roughly L-shaped. Here the region 43 of the housing 2 in which the jumper rail 9 is movably guided has an open bottom. This leads to a situation in which when the jumper 1 is arranged in the two modular terminals 3, 3' as shown in FIG. 9 for example a contact pin can be inserted through the open bottom of the housing 2 through the functional slot 42 into the third opening 7 in the two busbars 4, 4'. Likewise, with the jumper 1 plugged in, the terminal openings 38 are accessible so that an electrical conductor, even with the jumper 1 plugged in, can be connected to the electrical modular terminal 3, 3'. In contrast thereto, the actuating opening 44 in the terminal housing 36, 36', for a jumper 1 which has been plugged in as shown in FIG. 10, is only accessible when the jumper rail 9 is not in the first end position, but in the second end position. This ensures that one conductor can only be removed from the terminal element 37 when a connected current transformer is short-circuited by the jumper 1.

Figure 11:
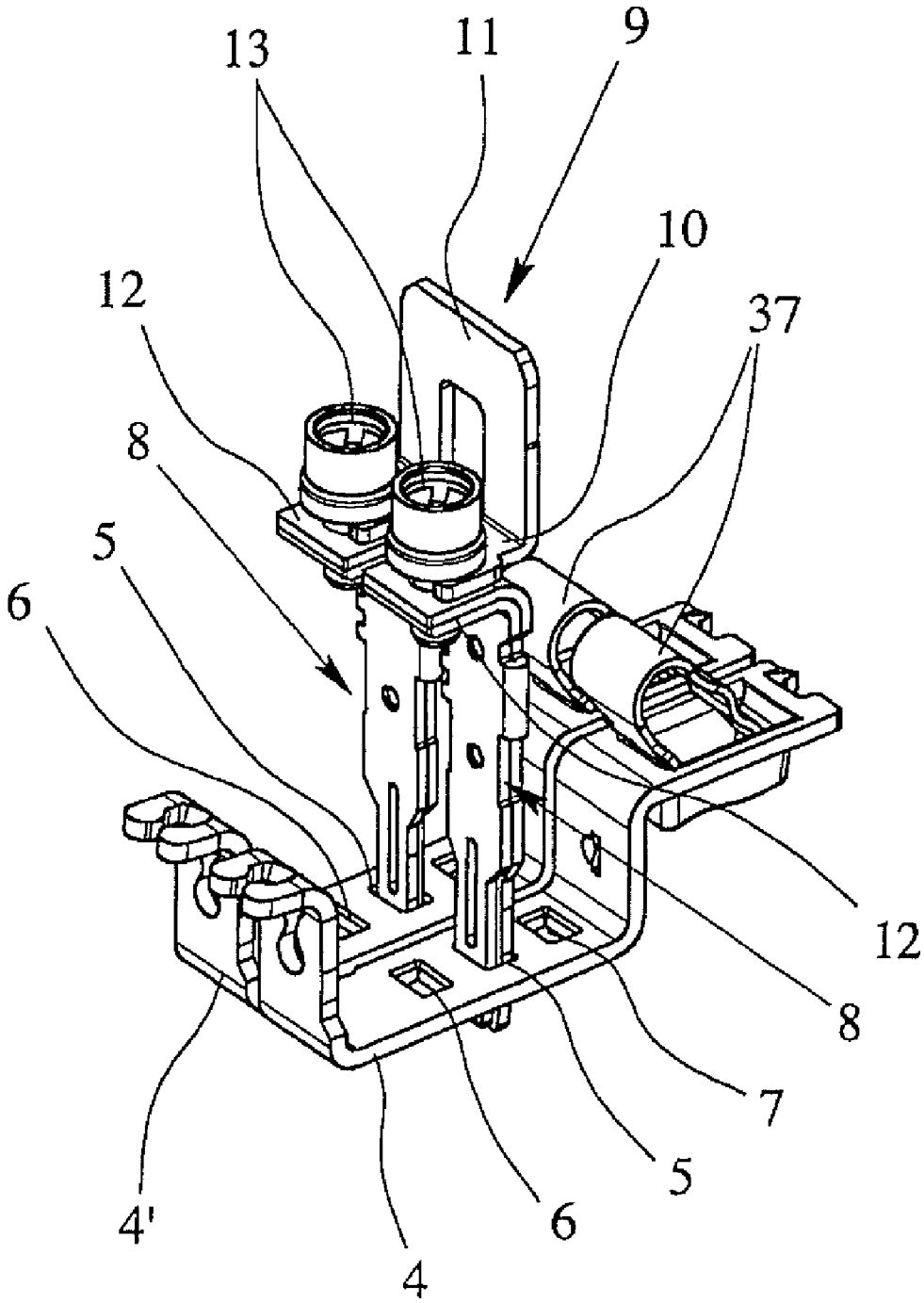
FIG. 11 shows the metal parts which are located in the right half of the structural unit as shown in FIG. 8.

FIG. 11 again shows that the two contacts 8 of the jumper 1 as shown in FIGS. 1(*a*), 1(*b*) and 2 are connected to one another in an electrically conductive manner only when the jumper rail 9 is in the second end position. In this position, then, the two contacts 8, and thus also the two busbars 4, 4' in whose openings 5 the two contacts 8 have been plugged, are connected to make contact with one another in an electrically conductive manner via the jumper rail 9, so that two modular terminals 3, 3' which are located adjacent to one another are short-circuited by the correspondingly switched jumper 1.

What is claimed is:

1. Jumper for bridging at least two electrical modular terminals which are located next to one another, the modular terminals each having at least one busbar and at least one opening formed in the busbars, the jumper comprising:

a housing at least two contacts insulated from one another in the housing for engaging an opening in a respective one of the busbars and a jumper rail movably held in the housing, the jumper rail having at least two contact regions and a connecting region which connects the contact regions, the jumper rail being movable out of a first end position in which the contact regions do not make contact with the contacts, into a second end position in which the contacts are connected to one another in an electrically conductive manner via the jumper rail.

2. Jumper as claimed in claim 1, wherein ends of the contacts facing the contact regions of the jumper rail and the contact regions of the jumper rail are located parallel to one another, wherein a respective screw is screwed in the ends of the contacts facing the contact regions of the jumper rail and wherein a respective contact region in the second end position of the jumper rail is connected in an electrically conductive manner to the end of the contact by means of the respective screw.

3. Jumper as claimed in claim 2, wherein the contact regions of the jumper rail each have a recess which is open one side and which extends at least partially around a shaft of the screw in the second end position of the jumper rail.

4. Jumper as claimed in claim 1, wherein the ends of the contacts facing the contact regions of the jumper rail and the contact regions of the jumper rail are lockable to one another in the second end position of the jumper rail.

5. Jumper as claimed in claim 4, wherein the ends of the contacts have a pin-shaped locking element and the contact regions having a catch recess for locking thereof together.

6. Jumper as claimed in claim 1, wherein the connecting region of the jumper rail is located at least partially in an insulating housing or jacketing.

7. Jumper as claimed in claim 1, wherein at least one brace which runs in a displacement direction of the jumper rail is formed in the housing of the jumper, wherein at least one groove corresponding to the at least one brace is formed in the connecting region or in the insulating housing of the jumper rail, and wherein the jumper rail is guided with the groove on the brace during displacement from one end position to the other end position.

8. Jumper as claimed in claim 1, wherein two guide grooves are formed in the side walls of the housing and wherein two corresponding guide ribs are formed laterally on the jumper rail.

9. Jumper as claimed in claim 1, wherein a stop is formed in the housing for the jumper rail in at least one of the first end position and the second end position.

10. Jumper for bridging at least two electrical modular terminals which are located next to one another, the modular terminals each having at least one busbar and at least one opening formed in the busbars, the jumper comprising:

a housing, the housing being lockable in the modular terminals, wherein a plug-in jumper with at least two contacts which are connected to one another in an electrically conductive manner via a connecting region is arranged to be axially movable in the housing from a first position in which the contacts are out of contact with the openings in the busbars into a second position in which the contacts engage a respective opening in the busbars.

11. Jumper as claimed in claim 10, wherein at least the connecting region of the plug-in jumper is located in an insulating housing.

12. Jumper as claimed in claim 11, wherein at least one guide rib is provided on the housing and at least one corresponding guide groove is provided in the insulating housing.

13. Jumper as claimed in claim 11, wherein an actuating element is pivotally mounted on the housing, the actuating element having one end pivotably connected to the insulating housing, pivoting of the actuating element moving the plug-in jumper out of the first position into the second position.

14. Jumper as claimed in claim 12, wherein a second end of the actuating element has a receiver for insertion of a tool for producing pivoting of the actuating element.

15. Jumper as claimed in claim 1, wherein the contacts are spring contacts, each spring contact having two contact legs which are arranged parallel to one another and at least one of which is elastic.

16. Jumper as claimed in claim 1, wherein at least two elastic catch elements are provided on the housing for locking in a respective second opening in one of the busbars.

17. Structural unit, comprising:

at least two electrical modular terminals located next to one another, each of the modular terminals having a terminal housing formed of insulating material, at least two terminal elements located in the terminal housing and at least one busbar in the terminal housing, at least two functional slots being provided in the terminal housing and at least two positionally corresponding openings in the busbars and a jumper, the jumper having a housing in which there are at least two contacts that are insulated from one another and which are engageable in a respective one of the openings in one of the busbars of the modular terminals, and a jumper rail that is movable in the housing of the jumper, the jumper rail having at least two contact regions and a connecting region which connects the contact regions and wherein the jumper rail being movable out of a first end position in which the contact regions are out of contact with each other into a second end position in which the contacts are connected to one another in an electrically conductive manner via the jumper rail.

18. Structural unit as claimed in claim 17, wherein at least one brace which runs in a displacement direction of the jumper rail is formed in the housing of the jumper, wherein at least one groove corresponding to the at least one brace is formed in the connecting region or in the insulating housing of the jumper rail, and wherein the jumper rail is guided with the groove on the brace during displacement from one end position to the other end position.

19. Structural unit as claimed in claim 18, wherein a stop for the jumper rail in the first end position and a stop for the jumper rail in the second end position is provided in the housing of the jumper, the stop for the jumper rail in the second end position being made as a partition which runs transversely to the displacement direction of the jumper rail.

20. Structural unit as claimed in claim 17, wherein the housing of the jumper is approximately L-shaped, and wherein a region of the housing in which the jumper rail is movable in the housing has an open bottom so that a tool or a contact pin can be pushed through the open bottom of the housing of the jumper when the jumper rail is located in the second end position.

21. Structural unit as claimed in claim 20, wherein the housing of the jumper is dimensioned such that the jumper can be plugged into the housing of adjacent jumpers so that a conductor connected to a terminal element cannot be removed from the terminal element when the jumper rail is in the first end position.

22. Structural unit comprising:

at least two electrical modular terminals which are located next to one another, the modular terminals each having a terminal housing made of insulating material, with at least two terminal elements located in the terminal housing and at least one busbar in the terminal housings, at least two functional slots being provided in the terminal housing and at least two positionally corresponding openings being formed in the busbars, and a jumper which has a jumper housing, the jumper housing being lockable in the modular terminals, a plug-in jumper that is arranged to move axially in the housing, the plug-in jumper having at least two contacts which are connected to one another in an electrically conductive manner via a connecting region, and wherein the plug-in jumper is moved out of a first position in which the contacts are out of contact with the openings in the busbars into a second position in which the contacts are engaged in a respective one of the openings in the busbars.

23. Structural unit as claimed in claim 22, wherein there are at least two elastic catch elements on the jumper housing for locking in a respective second one of the openings of the busbars, the catch elements having two elastic catch hooks facing one another.

24. Structural unit as claimed in claim 18, wherein in the terminal housings of the modular terminals are provided with an additional functional slot for insertion of a contact pin of a test plug or a plug-in jumper.

* * * * *